US008985017B2

(12) United States Patent
Caron

(10) Patent No.: US 8,985,017 B2
(45) Date of Patent: Mar. 24, 2015

(54) VARIABLE CUTOFF PRINTING PRESS WITH OFF IMPRESSION GAP

(71) Applicant: Goss International Americas, Inc., Durham, NH (US)

(72) Inventor: Glen Roger Caron, Deerfield, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/654,117

(22) Filed: Oct. 17, 2012

(65) Prior Publication Data

US 2014/0102325 A1 Apr. 17, 2014

(51) Int. Cl.

| | |
|---|---|
| ***B41F 13/24*** | (2006.01) |
| ***B41F 13/34*** | (2006.01) |
| ***B41F 7/02*** | (2006.01) |
| ***B41F 13/20*** | (2006.01) |
| ***B41F 13/32*** | (2006.01) |
| ***B41F 13/40*** | (2006.01) |
| ***B41F 13/44*** | (2006.01) |

(52) U.S. Cl.

CPC . *B41F 7/02* (2013.01); *B41F 13/20* (2013.01); *B41F 13/32* (2013.01); *B41F 13/40* (2013.01); *B41F 13/44* (2013.01)

USPC ..... 101/218; 101/247; 101/137; 101/140; 101/144; 101/182; 101/185

(58) Field of Classification Search

USPC ..... 101/218

See application file for complete search history.

(56) References Cited

U.S. PATENT DOCUMENTS

| | | | | |
|---|---|---|---|---|
| 2,874,636 | A * | 2/1959 | Royer et al. | 101/218 |
| 4,216,718 | A * | 8/1980 | Gaston et al. | 101/247 |
| 4,369,705 | A * | 1/1983 | Gelinas | 101/177 |
| 4,691,631 | A * | 9/1987 | Ishii et al. | 101/218 |
| 5,337,664 | A * | 8/1994 | Hannon | 101/218 |
| 5,690,029 | A * | 11/1997 | Herrmann et al. | 101/218 |
| 5,813,336 | A | 9/1998 | Guaraldi et al. | |
| 6,227,111 | B1 * | 5/2001 | Dawley et al. | 101/218 |
| 6,694,877 | B1 | 2/2004 | Wolters et al. | |
| 2012/0012017 | A1 | 1/2012 | Zlatin et al. | |

* cited by examiner

*Primary Examiner* — Jill Culler

(74) *Attorney, Agent, or Firm* — Davidson, Davidson & Kappel, LLC

(57) ABSTRACT

A variable cutoff printing press includes a plate cylinder, a plate cylinder support removably supporting the plate cylinder, a blanket cylinder, a blanket cylinder support removably supporting the blanket, an impression cylinder and an impression cylinder support. An actuator for moving the blanket cylinder support accommodates different blanket cylinder sizes, the actuator further moving the impression cylinder support so that regardless of blanket cylinder size a gap exists between the blanket cylinder support and the impression cylinder support. An on impression actuator moves the impression cylinder support against the blanket cylinder support to set a desired print load. A method is also provided.

10 Claims, 4 Drawing Sheets

VARIABLE CUTOFF PRINTING PRESS WITH OFF IMPRESSION GAP

The present invention relates generally to printing presses and more specifically to variable cutoff printing presses.

BACKGROUND OF INVENTION

U.S. Pat. No. 5,813,336, hereby incorporated by reference herein, discloses a printing unit with a rotatable print cylinder and a rotatable blanket cylinder. A tubular printing blanket is removably mounted on the blanket cylinder. The printing unit may have an imaging unit mounted therein. A printing member, which is mountable on the print cylinder, is imaged by the imaging unit inside the printing unit. The printing member has a continuous surface and may be removed axially from the print cylinder. The printing unit may be configured as a cantilever printing unit, or, alternatively, may be configured with both a gear side frame and a work side frame for supporting the print and blanket cylinders. In order to provide a variable-cutoff capability, a plurality of print cylinder saddles may be provided. Each print cylinder saddle has the same inner diameter for mounting on the print cylinders. However, in order to provide a variable cut-off, the print cylinder saddles may have a variety of outer diameters.

U.S. Pat. No. 6,694,877 discloses a printing assembly including an image printing cylinder, a transfer printing cylinder and an impression printing cylinder. The image printing cylinder is supported in a fixed position with respect to a U-shaped supporting construction, the transfer printing cylinder is supported on both ends between two supporting elements and the impression printing cylinder is supported on both ends between two supporting elements. The supporting elements are connected to respective bearing arms that are rotatable about a single axis. The bearing arms of the transfer printing cylinder are each rotated by respective first actuating means and the bearing arms of the impression printing cylinder are each rotated by respective second actuating means. The second actuating means are connected to the bearing arms of the transfer printing cylinder, causing the second actuating means to move along with a rotation of the bearing arm of the transfer printing cylinder if the first actuating means are actuated.

BRIEF SUMMARY OF THE INVENTION

U.S. patent application No. 2012/0012017 A1, hereby incorporated by reference herein, discloses a variable cutoff printing unit. Two separate actuators move each of a blanket cylinder and an impression cylinder, and permit different sized blankets and plate cylinders to be accommodated. The impression cylinder actuator can move downwardly to move the impression cylinder off impression, the blanket cylinder also moving into an off impression position via a slot and cam interaction on the blanket cylinder actuating mechanism. A stop may be positioned against an adjustable block and the stop position can be set via an adjustable stopping device and smart motor so that center distances between the plate cylinder and the blanket cylinder can be set, for example for different sized cylinders.

If a wrong stop position is set or a cylinder size is changed without proper adjustments, sometimes the actuators can fail or apply too much force, causing damage to the printing press. This is especially so if certain types of mechanisms are used to position the impression and blanket cylinder movement, for example a single pneumatic actuator.

The present invention provides a variable cutoff printing press including a plate cylinder; a plate cylinder support removably supporting the plate cylinder; a blanket cylinder; a blanket cylinder support removably supporting the blanket; an impression cylinder; an impression cylinder support; an actuator for moving the blanket cylinder support to accommodate different blanket cylinder sizes, the actuator further moving the impression cylinder support so that regardless of the blanket cylinder size a gap exists between the blanket cylinder support and the impression cylinder support; and an on impression actuator for moving the impression cylinder support against the blanket cylinder support to set a desired print load.

The present invention also provides a method of operating a variable cutoff printing press including: setting a first desired blanket cylinder position for a first blanket cylinder using a first actuator, the impression cylinder also being moved by the actuator while a gap is maintained between a blanket cylinder support and an impression cylinder support; placing the first blanket cylinder, impression cylinder and a first plate cylinder on impression using a further actuator to force the impression cylinder support against the blanket cylinder support; setting a second desired blanket cylinder position for a different sized second blanket cylinder using the first actuator, the gap being maintained between the blanket cylinder support and the impression cylinder support; and placing the second blanket cylinder the impression cylinder and a second plate cylinder on impression using the further actuator to force the impression cylinder support against the blanket cylinder support.

BRIEF DESCRIPTION OF THE DRAWINGS

The present invention is described below by reference to the following drawings, in which.

DETAILED DESCRIPTION

A variable cutoff printing press as used herein refers to a printing press that can be modified between print jobs so that the printing press can print repeating images of different lengths during different print jobs. The length of the repeating images printing during a particular print job is commonly referred to as a cutoff length or a cutoff. Plate cylinders and blanket cylinders that print the repeating images for the particular print job (and the plates and blanket mounted on the cylinders) may be said to have that cutoff length or cutoff. For example, a variable cutoff printing unit can print repeating images of a first cutoff length on a web or other substrate during a first print job and then can print repeating images of a second cutoff length that varies from the first cutoff length on a web or other substrate during a subsequent second print job. The first print job is printed using a first printing plate and a first printing blanket each having an outer circumference of a length corresponding to the first cutoff length. After the first print job and before the second print job, the first printing plate and the first printing blanket are removed from the printing unit and replaced with a second printing plate and a second printing blanket that each has an outer circumference of a length corresponding to the second cutoff length. A change between print jobs that involves replacing printing plates and blankets having a first cutoff length with printing plates and blankets having a second cutoff length may be referred to as a cutoff change.

The printing press of the present invention preferably is a web offset lithographic printing press.

Figure 1:
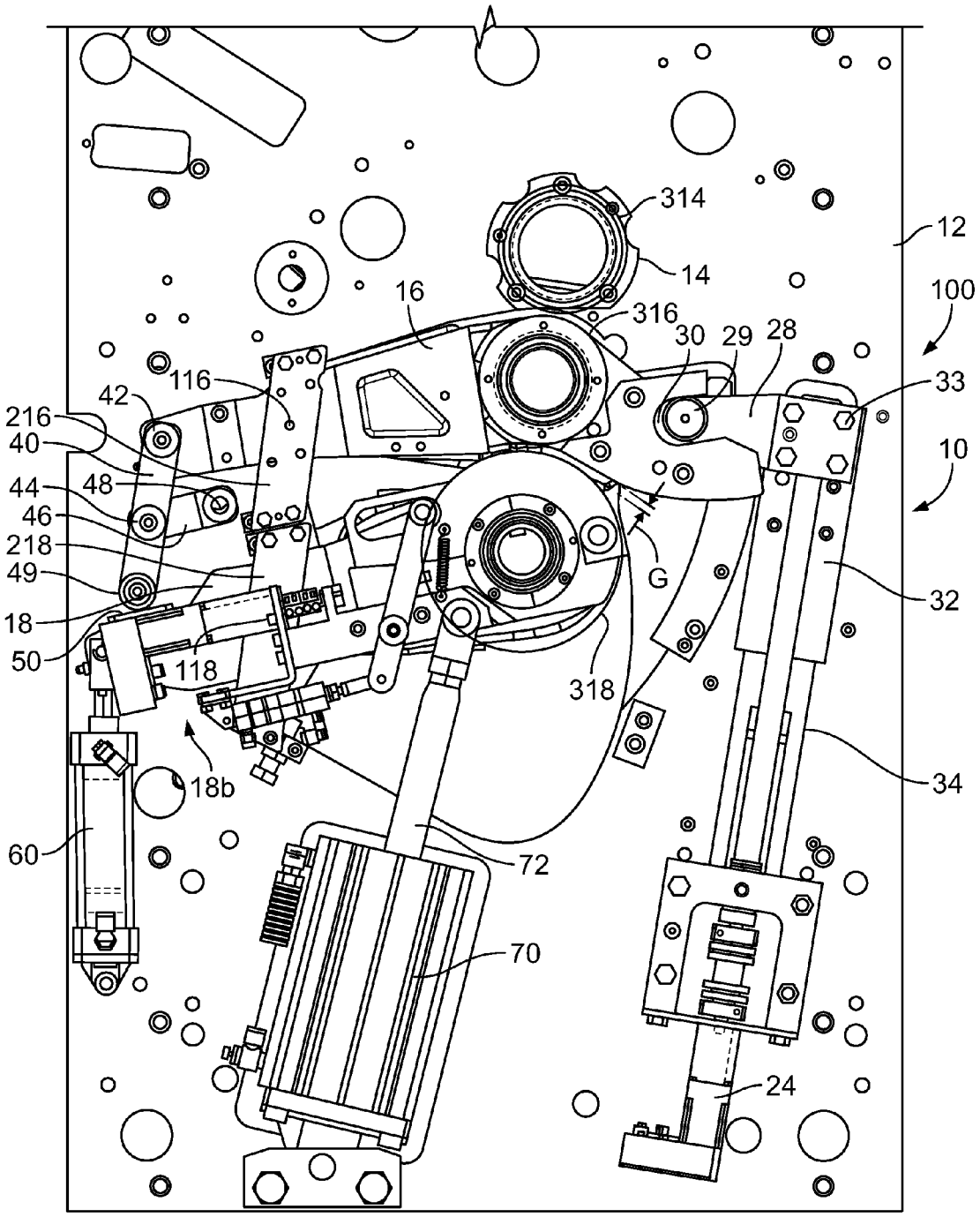
FIG. 1 shows a side view of an inside portion of a gear side of a support apparatus for removably supporting different sized plate cylinders and blanket cylinders of a variable cutoff printing unit, the plate and blanket cylinders in this embodiment being for a 16 inch cut-off, off impression.

FIG. 1 shows a side view of a support apparatus 10 for removably supporting plate cylinders, blanket cylinders and impression cylinders in a variable cutoff printing unit. Support apparatus 10 has a gear side and a work side and includes a frame 12. FIG. 1 shows an inside portion of gear side of support apparatus 10. Gear side of support apparatus 10 includes a plate cylinder support 14, here fixed to the frame 12.

A pivotable blanket cylinder support 16 is coupled to frame 12 at a pivot point 116, for example by supports 216, and a pivotable impression cylinder support 18 likewise can pivot with respect to frame 10 at a pivot point 118, for example using supports 218.

Cylinder supports 14, 16, 18 are adapted to support a first axial end of a plate cylinder 314, blanket cylinder 316 and impression cylinder 318, respectively. In FIG. 1 the plate cylinder 314 and blanket cylinder 316 may be for 16 inch cutoff, and are shown off impression.

Support apparatus 10 has a blanket cylinder support setting device 100 that includes an arm 28, a sliding element 32 and blanket cylinder support actuator 24 for moving blanket cylinder support 16. Arm 28 is fixedly connected to sliding element 32, for example via bolts 33 and can couple sliding element 32 to blanket cylinder support 16 so actuator 24 can lift blanket cylinder support 16. Actuator 24 adjusts the vertical position of blanket cylinder support 16 by moving sliding element 32 in slot 34. Actuator 24 moves sliding element along frame 12 to move blanket cylinder support 16 toward and away from plate cylinder support 14. Arm 28 includes a roller cam 29, which may extends into a blanket cylinder support slot 30 formed in blanket cylinder support 16. The roller cam 29 and slot 30 interaction may be similar to that described in incorporated-by-reference U.S. patent application No. 2012/0012017. However, other details differ significantly, including that actuator 24 may be a motor that does not just set a stopping device or move the sliding element as far as possible, but actually both sets and positions the sliding element 32.

In addition, as the sliding element 32 moves through its various positions to accommodate different sized blanket and plate cylinder sizes, during off impression a gap G is maintained between the blanket cylinder support 16 and impression cylinder support 18. A gap thus is also maintained between the blanket cylinder 316 and impression cylinder 318.

The maintenance of gap G is accomplished by a linkage 40 between blanket cylinder support 16 and impression cylinder support 18. Linkage 40 is rotatably connected at connection 42 to blanket cylinder support 16 and at a central connection 44 via a pivot link 46 rotatably connected at a connection 48 to frame 10. A roller 49 at the other end of linkage 40 from connection 42 can roll on a support surface 50 of impression cylinder support 18.

The weight of impression cylinder 318 forces impression cylinder support 18 in contact with linkage 40. A counterbalance cylinder 60 is energized to pull down on impression cylinder support 318 and minimize the force it take for first actuator 24, via linkage 40, to move impression cylinder 318 toward plate cylinder support 14, in FIG. 1 clockwise about pivot point 118. An on-impression actuator 70 is deenergized, and only energized when on impression is needed after the plate and blanket cylinders have been changed.

Figure 2:
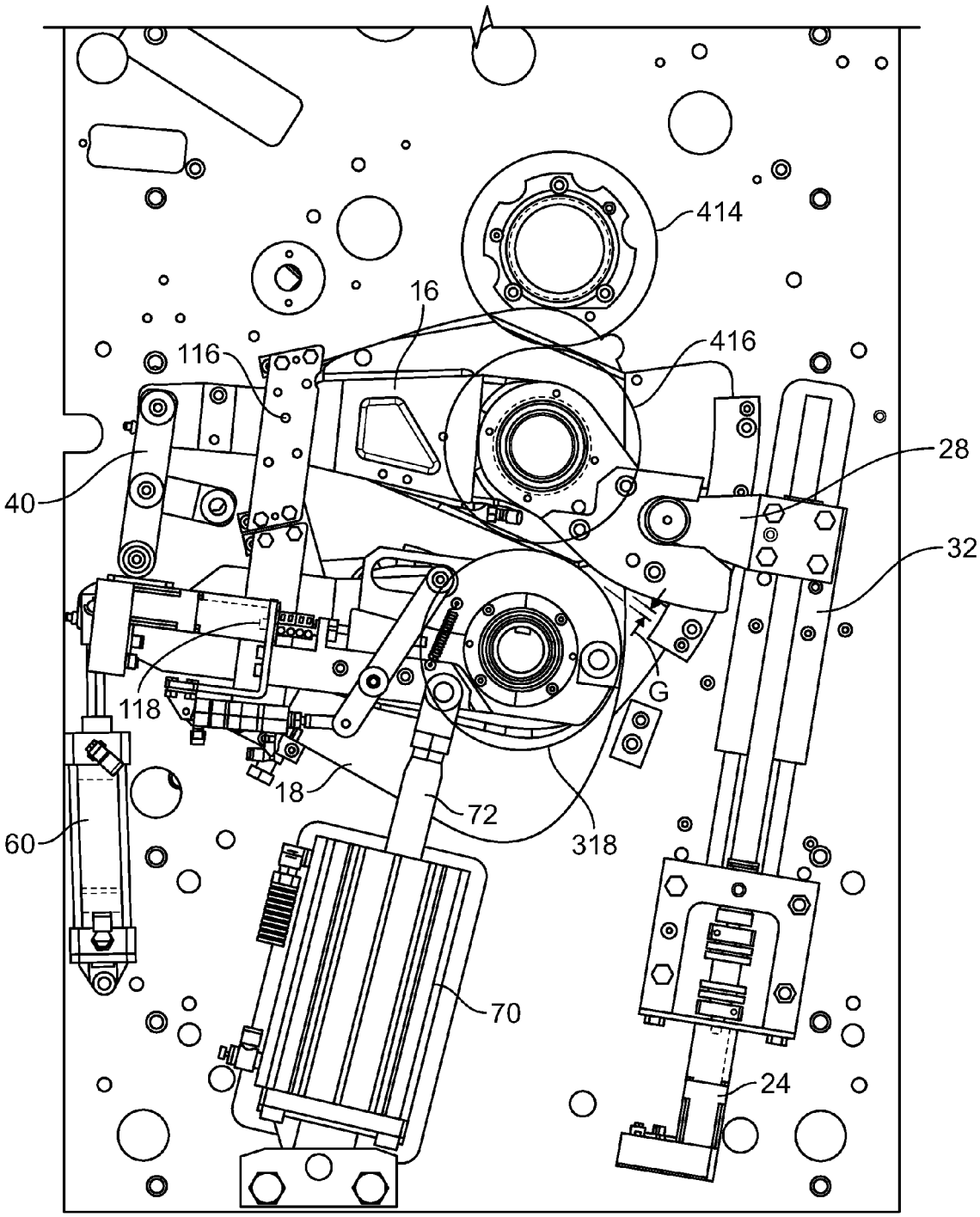
FIG. 2 shows the side view of FIG. 1 with the support apparatus adjusted to accommodate cylinders of a 24 inch cut-off.
Figure 3:
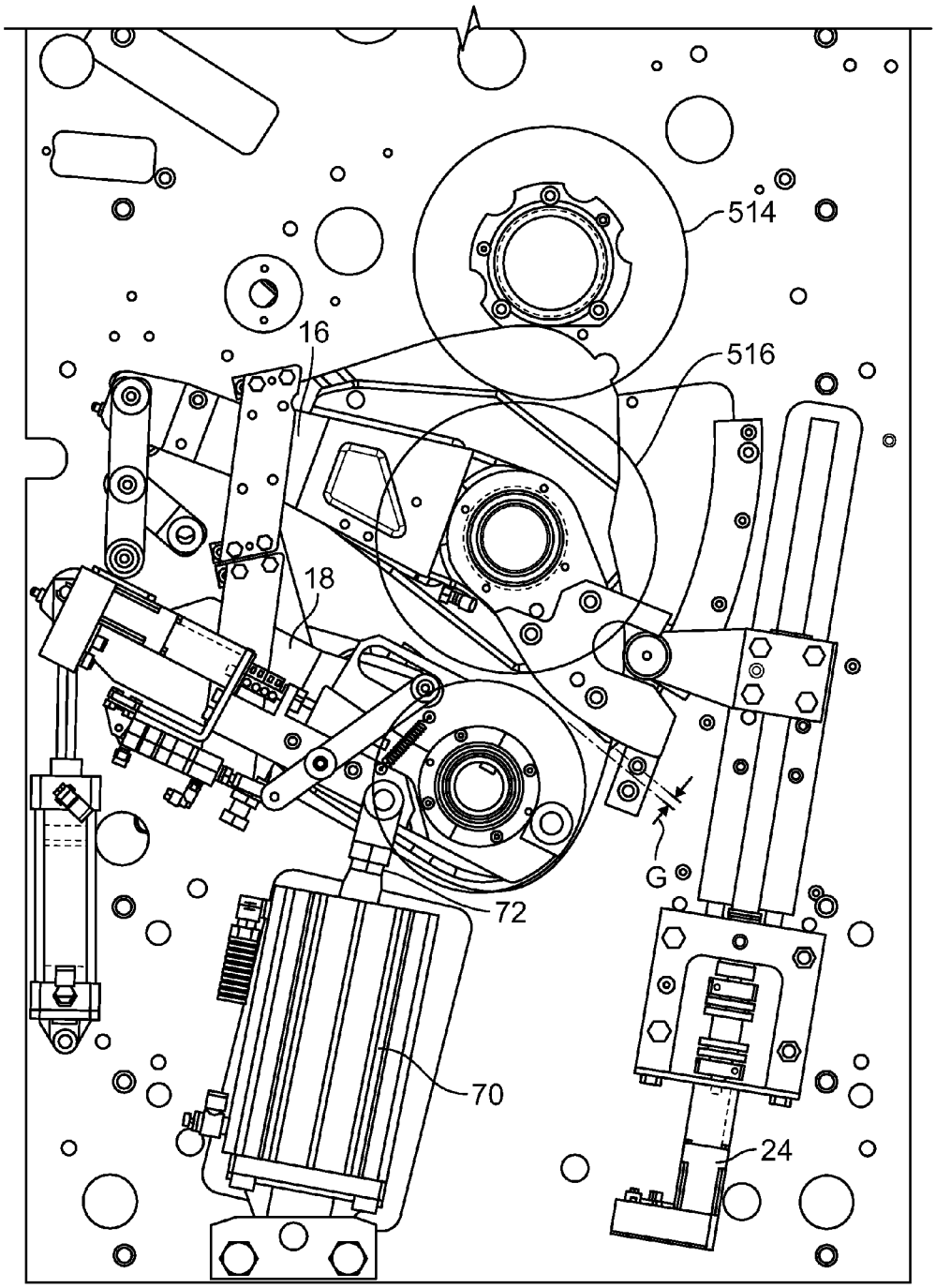
FIG. 3 shows the side view of FIG. 1 with the support apparatus adjusted to accommodate cylinders of a 32 inch cut-off.

FIGS. 2 and 3 thus show the movement of the support apparatus as different sized plate and blanket cylinders are used.

As shown in FIG. 2, to place 24 inch cut-off plate cylinder 414 and blanket cylinder 416 on the variable cut-off printing press, actuator 24, for example by rotating a threaded screw, moves sliding element 32 downwardly so that arm 28 and roller cam 29 rotate blanket cylinder support 16 clockwise about pivot point 116, via slot 30. As linkage 40 thus moves upwardly, air cylinder 60 forces impression cylinder support 18 to move clockwise about pivot point 118, so that gap G is maintained. A gap between the new sized blanket cylinder 416 and impression cylinder 318 thus also results in the off-impression position.

FIG. 3 shows yet further movement of actuator 24 for 32 inch cutoff plate cylinder 514 and blanket cylinder 516, with gap G being maintained. The support apparatus 10 is in a further position, as described with respect to FIG. 2, where supports 16 and 18 have rotated yet further in the clockwise direction.

During movement by the actuator 24, on impression actuator 70 is de-energized so that its actuator arm 72 is free to move.

Figure 4:
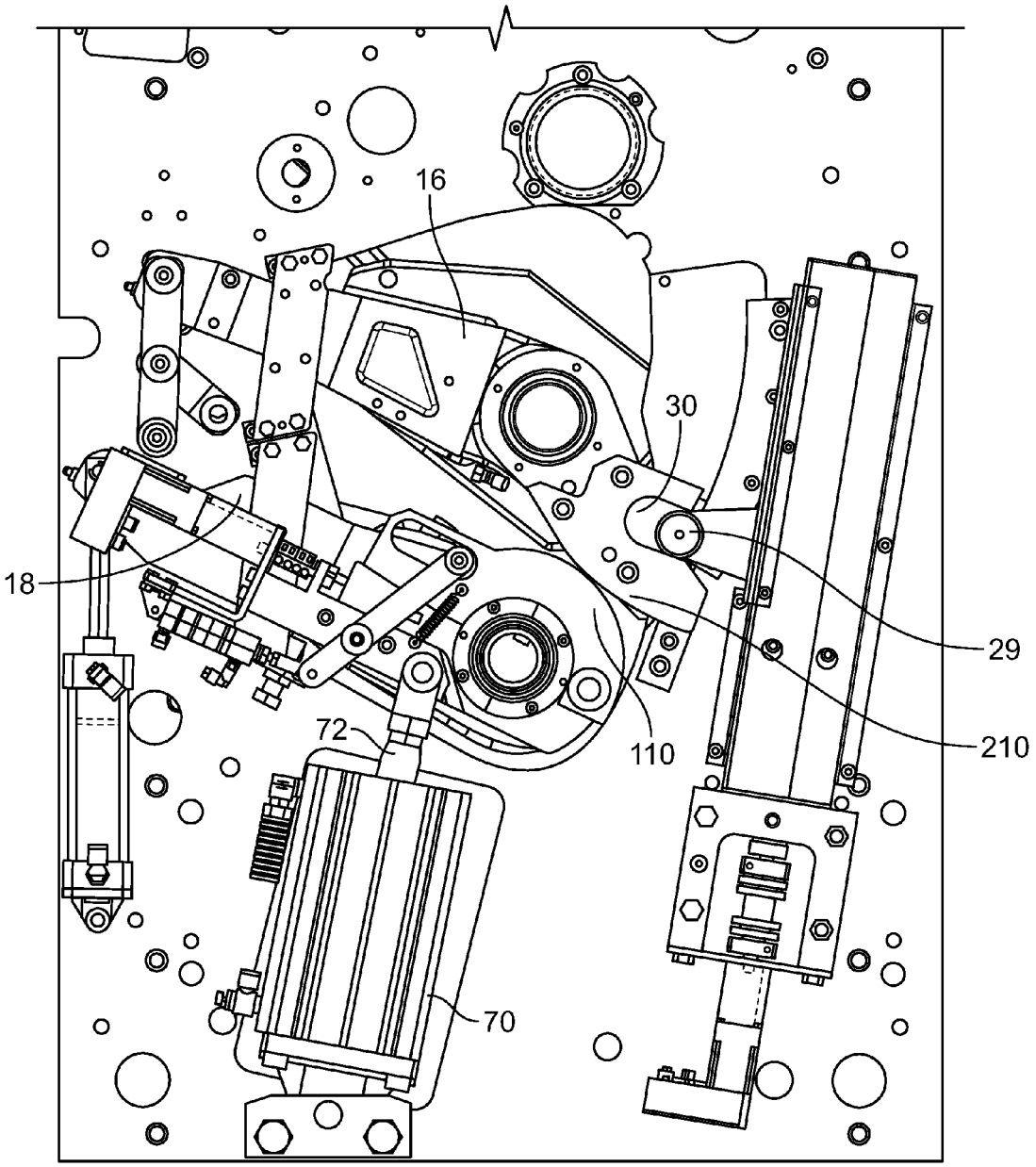
FIG. 4 shows the side view of FIG. 3 on impression.

FIG. 4 shows actuation and energizing of the on impression actuator 70, which may be a pneumatic cylinder. As shown in FIG. 4, plate and blanket supports 16, 18 are positioned for supporting 32 inch cutoff plate cylinder 514 and blanket cylinder 516, which are omitted for clarity, in an on impression position. To move the printing press on impression, actuator arm 72 is moved upwardly and causes a cam surface 110 of impression cylinder support 18 to contact a cam surface 210 of blanket cylinder support 16, and for gap G to disappear. Owing to the fact that roller 29 is slightly smaller in diameter than slot 30, blanket cylinder support 16 is also moved upwardly by the impression cylinder support 18 and creates the necessary print load between the respective blanket cylinder and plate cylinder.

Owing to the fact that the gap G between the blanket cylinder support 16 and impression cylinder support 18 is maintained throughout the course of movement of the support apparatus 10 for different sized cylinders, similar pressures can be created by the on impression actuator 70 regardless of the cylinder size. Over-torque situations or fault outs can be minimized or eliminated.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff printing press comprising:

a plate cylinder;

a plate cylinder support removably supporting the plate cylinder;

a blanket cylinder;

a blanket cylinder support removably supporting the blanket cylinder;

an impression cylinder;

an impression cylinder support;

an actuator for moving the blanket cylinder support about a pivot point to accommodate different blanket cylinder sizes, the actuator further moving the impression cylinder support so that regardless of blanket cylinder size a gap exists between the blanket cylinder support and the impression cylinder support;

an on impression actuator for moving the impression cylinder support against the blanket cylinder support to set a desired print load;

a linkage between the blanket cylinder support and the impression cylinder support, the linkage causing the impression cylinder support to rotate in a same direction as the blanket cylinder support; and a counterbalance cylinder forcing an end of the impression cylinder support downward.

2. The variable cutoff printing press as recited in claim 1 wherein the counterbalance cylinder is an air cylinder.

3. The variable cutoff printing press as recited in claim 1 wherein the impression cylinder is of fixed size.

4. The variable cutoff printing press as recited in claim 1 wherein the on impression actuator is pneumatic.

5. The variable cutoff printing press as recited in claim 1 wherein the actuator is a motor setting a position of the blanket cylinder support.

6. The variable cutoff printing press as recited in claim 1 wherein the press is a web offset lithographic printing press.

7. The variable cutoff printing press as recited in claim 1 further comprising a frame, the blanket cylinder support being coupled to the frame.

8. A method of operating a variable cutoff printing press including:

setting a first desired blanket cylinder position for a first blanket cylinder using a first actuator, an impression cylinder also being moved by the actuator via a linkage while a gap is maintained between a blanket cylinder support and an impression cylinder support, the first actuator rotating the blanket cylinder support and impression cylinder support in a same direction;

placing the first blanket cylinder, impression cylinder and a first plate cylinder on impression using a further actuator to force the impression cylinder support against the blanket cylinder support;

setting a second desired blanket cylinder position for a different sized second blanket cylinder using the first actuator, the gap being maintained between the blanket cylinder support and the impression cylinder support;

placing the second blanket cylinder the impression cylinder and a second plate cylinder on impression using the further actuator to force the impression cylinder support against the blanket cylinder support; and applying a counterpressure opposite the linkage pressure to the impression cylinder support.

9. The method as recited in claim 8 wherein the further actuator is pneumatically operated.

10. The method as recited in claim 8 wherein the press is a web offset lithographic printing press.

* * * * *